US005451024A

United States Patent [19]

Lai

[11] Patent Number: 5,451,024

[45] Date of Patent: Sep. 19, 1995

[54] HEIGHT ADJUSTING MECHANISM FOR A SWIVEL CHAIR

[76] Inventor: Yu-shan Lai, 48 Tachuwei Tachu Village Shuishang Hsiang, Chiayi Hsien,

[21] Appl. No.: 273,817

[22] Filed: Jul. 12, 1994

[51] Int. Cl.[6] ..... F16M 11/00

[52] U.S. Cl. ..... 248/406.2

[58] Field of Search ..... 248/406.2, 406.1, 405; 297/345, 348, 349

[56] References Cited

U.S. PATENT DOCUMENTS

| | | | |
|---|---|---|---|
| 3,870,271 | 3/1975 | Bowman | 297/349 X |
| 4,261,540 | 4/1981 | Baker | 248/406.2 |
| 4,379,540 | 4/1983 | French | 248/406.2 |
| 4,479,627 | 10/1984 | Wehner | 248/406.2 |
| 4,598,892 | 7/1986 | Franckowiak | 297/348 X |
| 4,720,071 | 1/1988 | Nelson | 297/345 |
| 4,828,212 | 5/1989 | Dicks | 297/348 X |
| 4,872,635 | 10/1989 | Knoblock | 297/349 X |
| 4,903,930 | 2/1990 | Jann | 248/406.2 |
| 5,342,012 | 8/1994 | Ryu | 248/406.2 |

FOREIGN PATENT DOCUMENTS

| | | | |
|---|---|---|---|
| 1032600 | 6/1966 | United Kingdom | 248/406.2 |

*Primary Examiner*—J. Franklin Foss
*Attorney, Agent, or Firm*—Browdy and Neimark

[57] ABSTRACT

An improved height adjusting mechanism for a swivel chair is equipped with a separable positioning ring block assembly including a ring block piece and an arc limiting piece that can be put together into a ring form. A screw shaft having an elongated groove is provided with two closed ends so that the positioning ring block assembly will effectively be restrained within the groove in adjustment, preventing an adjusting mount from dismount from a shaft tube due to excessive adjustment. Moreover, a peripheral flange is disposed at the bottom of the adjusting mount so that it can be readily coupled to a connecting journal disposed at the top end of the shaft tube.

1 Claim, 5 Drawing Sheets

HEIGHT ADJUSTING MECHANISM FOR A SWIVEL CHAIR

BACKGROUND OF THE INVENTION

The present invention relates to an improved height adjusting mechanism for use on a swivel chair which is provided with a screw shaft having an axial close-ended restraint groove, and a separable positioning ring block assembly including a ring block piece and an arc limiting piece that are easily matched into a ring form and received in a cavity at the top end of a shaft tube, and a cylindrical adjusting mount having a room at the bottom end thereof with a peripheral flange defined on the inner wall of the room, the flange is engaged with an extended connecting journal at the top of the shaft tube, making the assembly thereof easy and speedy. Such a close-ended groove can prevent disengagement of a ring block assembly from a screw shaft of a swivel chair due to excessive adjustment.

Swivel chairs have been popularly used in offices and places of the like because they provide comfort and facility in use. To make a swivel chair easily adjusted for people having different physical sizes to use, a prior art swivel chair, as shown in FIG. 1, is generally equipped with a height adjusting mechanism, as shown in FIG. 2.

Referring to FIG. 1, a conventional height adjusting mechanism of a swivel chair has a shaft tube 1, a shaft 2, a restraint ring member 3 and an adjusting mount 4. The shaft tube 1 has a tubular interior 11 in which the shaft 2 is housed. At the top end of the shaft tube 1 is disposed a journalled extension 12.

The shaft 2 with one end fixed to the center of the underside of a seat has an elongated groove 21 having either the upper end or lower end opened for easy fitting of the restraint ring member 3 slidably mounted onto the shaft with a protruded restraint piece 32 engaged with the elongated groove 21. The ring member 3 has a plurality of projection spots 31 on the top surface thereof.

The adjusting mount 4 having a through hole 41 for the passage of the screw shaft 2 is screwed onto the screw shaft. It has a room at the bottom end thereof for movable accommodation of the ring member 3. The ceiling of the room is provided with a downwardly extended projection 42, and a through hole 43 is disposed on the wall of the adjusting mount 4 so as to permit the mount 4 to be securedly engaged with the journalled extension 12 by way of a screw 44.

A conventional height adjusting mechanism is assembled in a way as described above. When a person sits on such a chair and swivels, the weight thereof forces the projection 42 of the adjusting mount 4 in limiting engagement with the protruded restraint pieces 31 and the restraint ring member 3 with the restraint piece 32 in engagement with the groove 21 is stopped from rotation, the screw shaft 2 rotates inside the shaft tube 1 without lifting or lowering with respect the adjusting mount 4. As the seat of a swivel chair is free, the adjusting mount 4 is not engaged With the restraint ring member 3 so that the ring member 3 along with the screw shaft 2 can be spinned together as the seat is rotated for adjustment of the height thereof.

The prior art height adjusting mechanism has the following disadvantages in operation, they are given as below:

1. The restraint ring member 3 having a projected restraint piece 32 is integrally made and can not be engaged with the elogaged groove 21 of the screw shaft 2 if the groove is not provided with an open end. However, the open ended groove 21 will cause the ring member 3 to easily separate from the screw shaft 2 accidently due to excessive adjustment, resulting in a separation of a seat from the screw shaft 2.
2. The adjusting mount 4 is secured to the shaft tube 1 by a screw. Most adjusting mount is made of plastics, so after a period of time, the adjusting mount is easily damaged or worn out.

SUMMARY OF THE INVENTION

Therefore, the primary object of the present invention is to provide an improved height adjusting mechanism for a swivel chair which adopts a positioning ring block assembly to limit a downward or upward adjustment of a seat of a swivel chair for safety, Another object of the present invention is to provide an improved height adjusting mechanism for a swivel chair having a positioning ring block assembly which is comprised of a ring block piece and an arc limiting piece that are easily assembled by first mounting the ring block piece to the shaft and then locating the arc limiting piece into engagement with an axial restraint groove of a screw shaft so as to keep both ends of the restraint groove on a shaft closed, preventing the positioning ring block assembly from disengagement from the screw shaft due to excessive adjustment, One further object of the present invention is to provide a height adjusting mechanism for a swivel chair having an adjusting mount which is provided with a room having a peripheral flange on the inner wall at the bottom thereof and engaging with a connecting journal disposed at the top of a shaft tube so as to make the assembly of the same easy and speedy.

DETAILED DESCRIPTION OF THE PREFERRED EMBODIMENT

Figure 1:
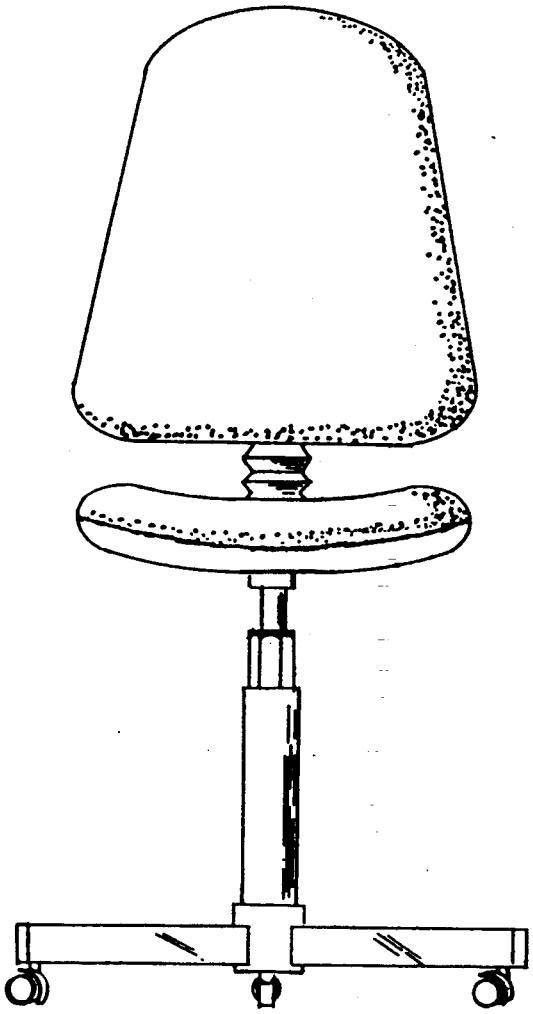
FIG. 1 PRIOR ART
FIG. 1 is a diagram showing a prior art swivel chair.
Figure 2:
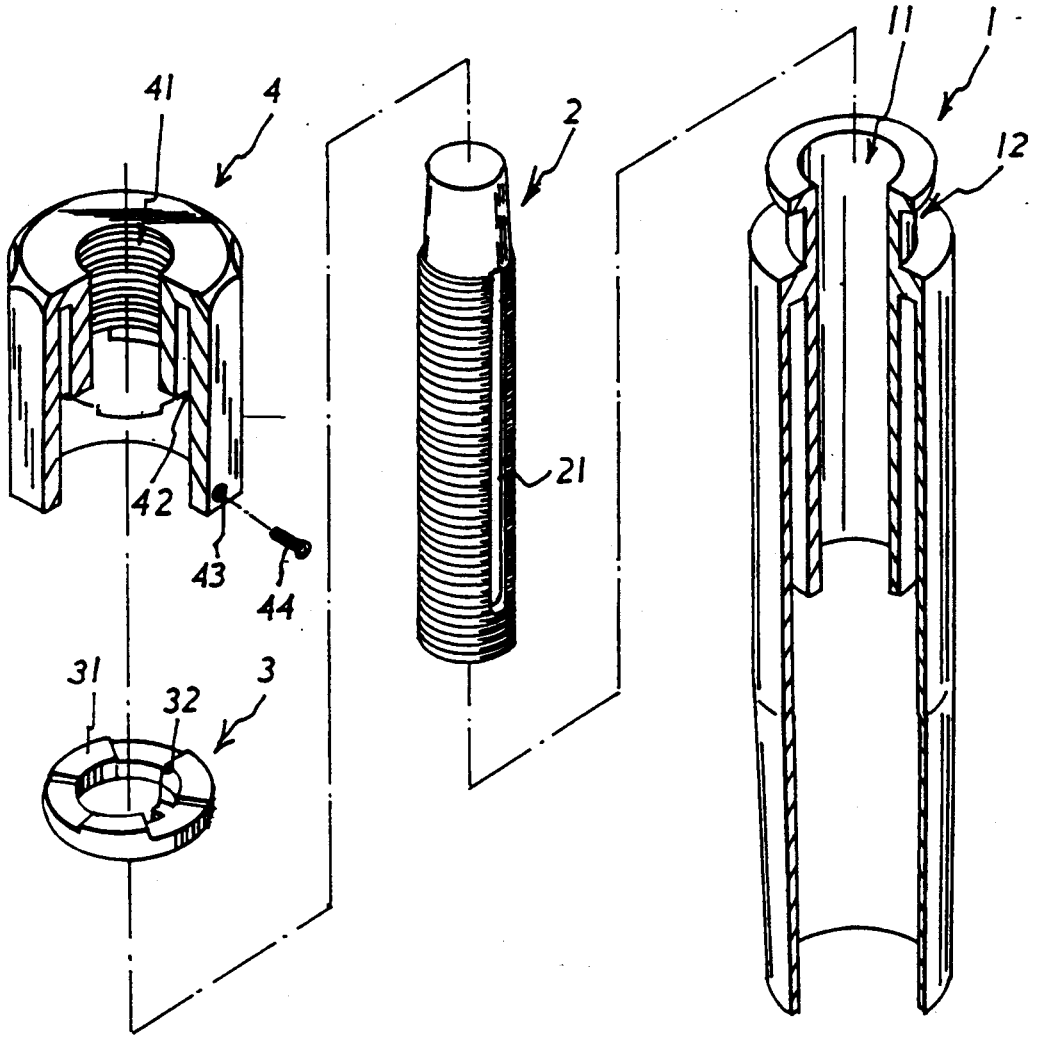
F I G. 2 PRIOR ART
FIG. 2 is a diagram showing exploded components of a prior art swivel chair.
Figure 3:
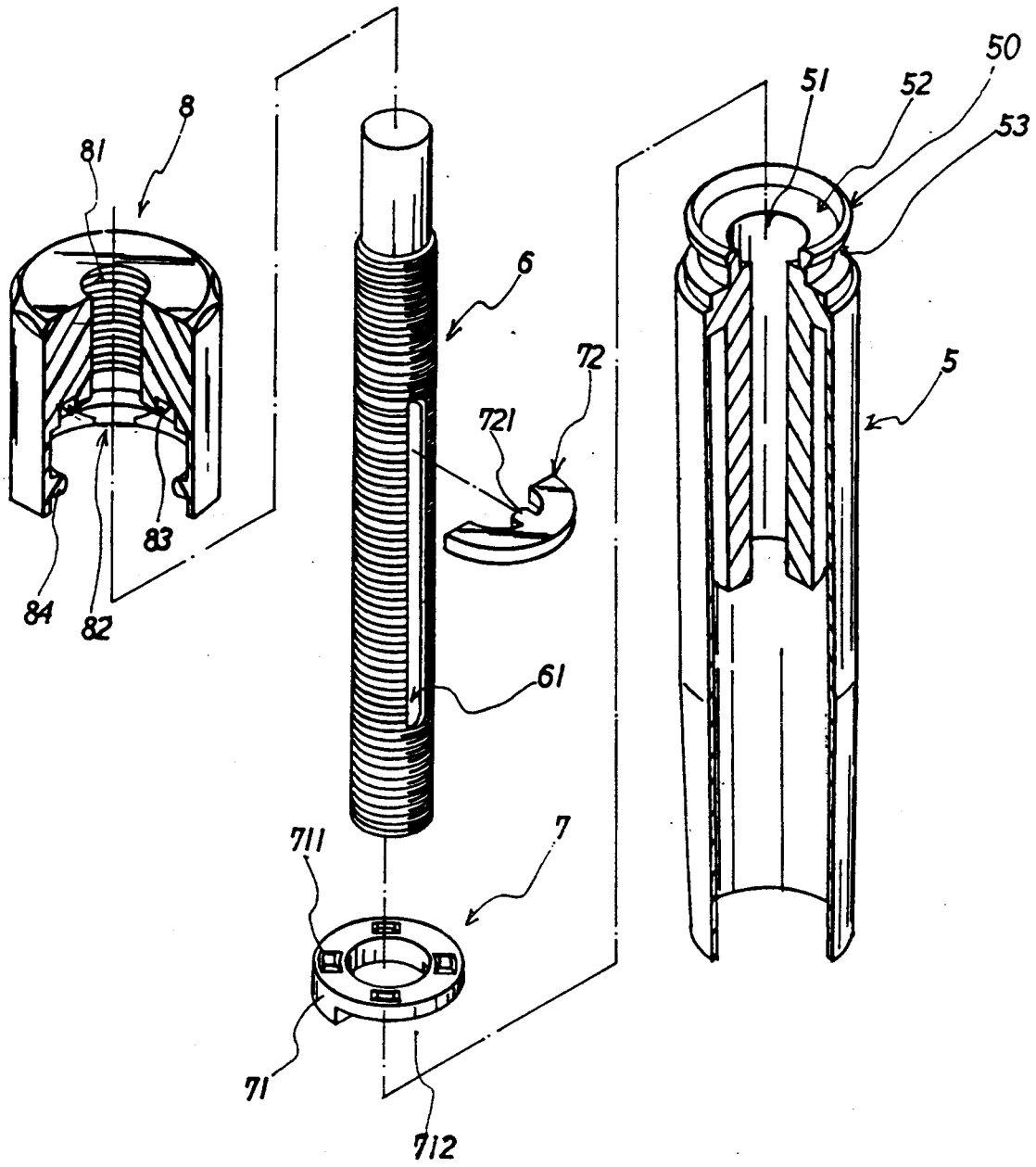
FIG. 3 is a diagram showing exploded components of the present invention.
Figure 4:
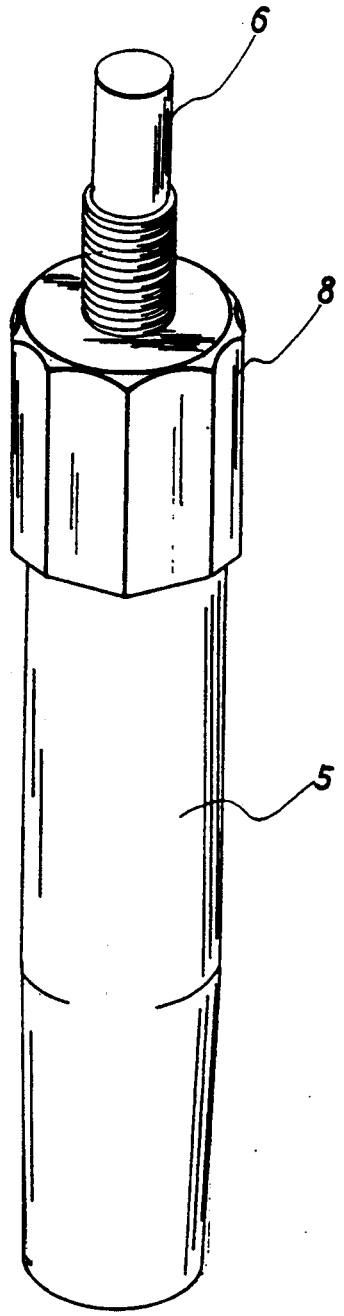
FIG. 4 is a diagram showing the assembly thereof.
Figure 5:
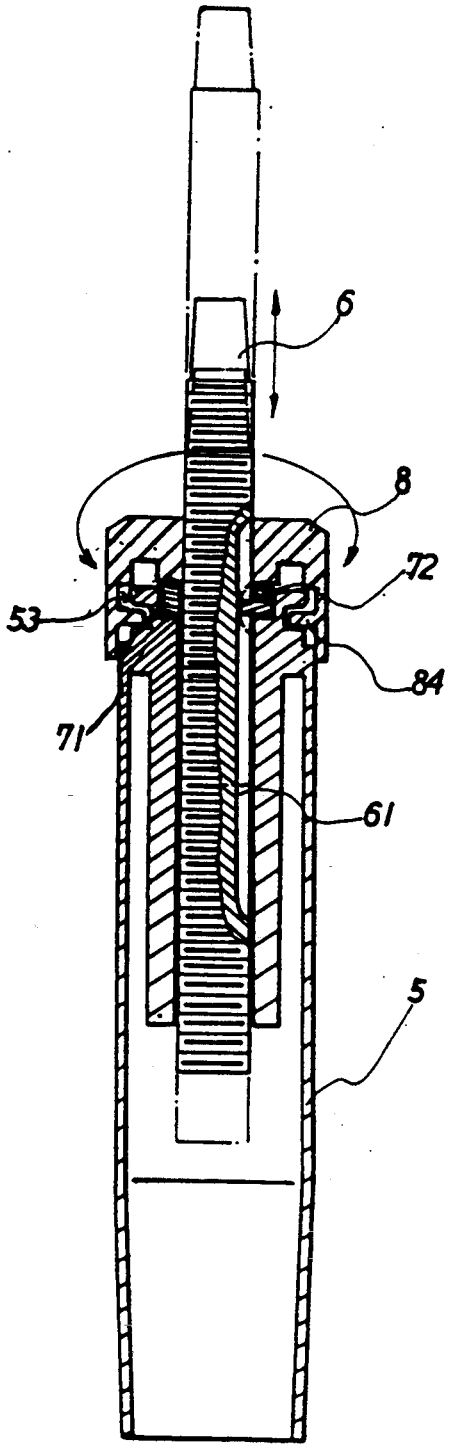
FIG. 5 is a sectional diagram showing the structure of the present invention.

Referring to FIGS. 3, 4, 5, the improved height adjusting mechanism of the present invention is comprised of a shaft tube 5, a screw shaft 6, a positioning ring block assembly 7 and an adjusting mount 8.

The shaft tube 5 has a hollow interior 51 for receiving the screw shaft 6 and an extended flange 50. A peripheral inner cavity 52 for accommodation of the positioning ring block assembly 7 is defined at the end of the extended flange 50. A connecting journal 53 is defined on the outer surface of the extended flange 50.

The screw shaft 6 is provided With an axial restraint groove 61 having closed ends. The positioning ring block assembly 7 is made up of a ring block piece 71 and a arc limiting piece 72. On the top surface of the ring block piece 72 are disposed a plurality of symmetrical protrusions 711. At the bottom of the ring block piece 71 is provided with a semi-circular cut 712 in conformance to the arc limiting piece 72 so as to accommodate the arc limiting piece 72 under the ring block piece 71 in assembly. A protrusion piece 721 disposed at the center of the arc limiting piece 72 is in slidable engagement with the axial restraint groove 61.

The cylindrical adjusting mount 8 having a hole 81 in conformance to the screw rod 6 which can be fitted inside the hole 81 and screwed to the adjusting mount 8 is provided with a room 82 at the bottom end thereof for operational accommodation of the positioning ring block assembly 7. The ceiling of the room 82 is provided with a downwardly extended protrusion 83. A peripheral flange 84 is disposed on the inner wall of the room 82 at the bottom thereof so as to permit the adjusting mount 8 to be engaged with the connecting journal 53 of the shaft tube 5 in assembly.

In assembly, the cylindrical adjusting mount 8 is screwed into engagement with the screw shaft 6 first, then the positioning ring block piece 71 is mounted onto the screw shaft 6 and the arc limiting piece 72 is located with the protrusion 721 disposed in alignment with the restraint groove 61 so as to assemble the ring block piece 71 and the arc limiting piece 72 into an integral positioning ring block assembly 7. The screw shaft 6 is housed in the shaft tube 5 and the positioning ring block assembly 7 is retained in place in the peripheral inner cavity 52 as a whole, afterwards, the adjusting mount 8 is secured to the shaft tube 5 by engaging the peripheral flange 84 with the connecting journal 53.

The present invention is characterized by that the separable positioning ring block assembly 7 including the ring block piece 71 and the arc limiting piece 72 can be mounted separably onto the screw shaft 6 with ease, permitting the axial restraint groove 61 to have close ends so as to prevent the positioning ring block assembly 7 from being disengaged from the screw shaft 6 due to excessive adjustment. Furthermore, the peripheral flange 84 of the adjusting mount 8 being engaged with the extended connecting journal 53 of the shaft tube 5 makes the assembly thereof easy and speedy.

Although the present invention has been described with a certain degree of particularity, the present disclosure has been made by way of example and changes in details of structure may be made without departing from the spirit thereof.

I claim:

1. An improved height adjusting mechanism for a swivel chair, comprising:

a screw shaft having an elongated axial restraint groove disposed thereon;

a shaft tube for receiving said screw shaft having an extended flange with a connecting journal disposed thereon;

a positioning ring block assembly in limiting engagement with said axial restraint groove of said screw shaft;

a cylindrical adjusting mount adjustably screwed to said screw shaft having a room at the bottom thereof for housing said positioning ring block assembly in such a manner that said ring block assembly can relatively move inside said room;

said room having a downwardly extended projection on a ceiling thereof which can be in selective engagement with one of a plurality of restraint protrusions;

wherein the improvement is characterized by that said positioning ring block assembly includes a ring block piece having a semi-circular cut, and an arc limiting piece located right under said ring block piece in conformance to said cut, that are assembled into a ring form and separable in assembly; said arc limiting piece having a restraint protrusion at the center thereof which is in limiting engagement with said axial restraint groove which has closed ends so that said arc limiting piece will not disengage from said restraint groove at either closed end thereof due to excessive adjustment; said ring block assembly is retained in place in a cavity at said extended flange; said adjusting mount has a peripheral flange on the inner wall of said room which can be in locking engagement with said connecting journal in assembly.

* * * * *